US005549479A

United States Patent [19]

Elco et al.

[11] Patent Number: 5,549,479

[45] Date of Patent: Aug. 27, 1996

[54] ZERO INSERTION FORCE CONNECTOR SYSTEM FOR A FLEXIBLE CIRCUIT

[75] Inventors: Richard A. Elco, Mechanicsburg, Pa.; Curt A. Williams, Raleigh, N.C.

[73] Assignee: Berg Technology, Inc., Reno, Nev.

[21] Appl. No.: 39,378

[22] PCT Filed: Nov. 18, 1992

[86] PCT No.: PCT/US92/09987

§ 371 Date: Apr. 30, 1993

§ 102(e) Date: Apr. 30, 1993

[87] PCT Pub. No.: WO93/10577

PCT Pub. Date: May 27, 1993

Related U.S. Application Data

[63] Continuation-in-part of Ser. No. 946,003, Sep. 15, 1992, abandoned, which is a continuation of Ser. No. 793,513, Nov. 18, 1991, abandoned.

[51] Int. Cl.[6] ..... H01R 9/09

[52] U.S. Cl. ..... 439/67; 439/267

[58] Field of Search ..... 439/62, 67, 77, 439/267, 329, 492, 493, 632, 635, 636, 637

[56] References Cited

U.S. PATENT DOCUMENTS

| | | | |
|---|---|---|---|
| 3,922,054 | 11/1975 | Dechelette | 439/67 |
| 4,871,315 | 10/1989 | Noschese | 439/67 |
| 4,911,643 | 3/1990 | Perry et al. | 439/67 |
| 5,080,595 | 1/1992 | Mouissie | 439/67 |

*Primary Examiner*—Neil Abrams

*Attorney, Agent, or Firm*—Woodcock Washburn Kurtz Mackiewicz & Norris

[57] ABSTRACT

A zero insertion force connector includes a pair of spring clamp jaws, each having a flexible circuit attached thereto. The clamp jaws are confrontationally arranged so that a portion of each clamp jaw adjacent to the rearward end thereof define a channel through which the flexible circuits pass. Each flexible circuit is attached to a spring clamp jaw within a region on the circuit that is free of tracings. An actuator provided within concave portions of each jaw to open the same and bring the conductive tracings on the flexible circuits into registration with the conductive tracings on a substrate. Wiping action between the tracings is generated by engagement between an abutment surface on a fixture and a camming surface carried on the connector. A centering action to register the tracings is simultaneously generated.

28 Claims, 8 Drawing Sheets

10
12A
12B
14A
14B
15A
15B
16
18
20
22
22T
22S1
22S2
24
24A
24B
24J
24S
26A
26B
28A
28B
30A
30B
32
34
36A
36B
38A
38B
39
42
44
50A
52A
52B
54A
54B
56A
56B
58B
60A
62A
66A
86A
86B
88
94A
94B
95B
100A
100B
102
106A
106B
114A
114B
116A
116B
128A
128B
130A
130B
134
B
C
S1
S2
T
2

ZERO INSERTION FORCE CONNECTOR SYSTEM FOR A FLEXIBLE CIRCUIT

This is a continuation-in-part of application Ser. No. 07/946,003, filed Sep. 15, 1992, which is a continuation of application Ser. No. 07/793,513, filed Nov. 18, 1991, both abandoned.

BACKGROUND OF THE INVENTION

1. Field of the Invention

The present invention relates to a connector system for a flexible circuit, and, in particular, to a zero insertion force connector system for interconnecting a flexible circuit to a substrate.

2. Description of the Prior Art

In general, mechanical connector structures in the form of an insulated housing with individual spring contact beams cannot be effectively utilized when the desired spacing between the conductors to which interconnection is desired is less than 0.050 inches. For such circumstances it is believed necessary to utilize a flexible circuit arrangement.

A flexible circuit is an electrical conductor structure in which a base sheet of polyimide or polyester film material has conductive tracings photolithographed thereon. Suitable for use as the base sheet for such flexible circuit arrangement is the polyimide or polyester film material such as manufactured and sold by E. I. du Pont de Nemours & Co. under the trademarks "Kapton" or "Mylar", respectively.

Such a flexible circuit may be interconnected with either a conventional circuit board substrate or another flexible circuit using any one of a variety of known connector constructions. For example, the flexible circuit may be wrapped about a core and the core secured in proximity to a substrate in the manner disclosed and claimed in U.S. Pat. No. 4,552,420 (Eigenbrode), assigned to the assignee of the present invention.

In another implementation the member to which the flexible circuit is to be connected may be clamped between a pair of parallel beams. This arrangement is shown in U.S. Pat. No. 4,647,125 (Landi et al.) and in the connector disclosed in U.S. Pat. No. 4,690,472 (Elco et al.), assigned to the assignee of the present invention. This last-mentioned patent is also noteworthy for its disclosure of wedge-shaped positioning guides which align the conductive features of the circuits being interconnected.

As another alternative the end of the flexible circuit may be bent around a mantle or curved tongue and brought into sliding engagement with the member to which it is to be connected. Contact with the flexible circuit is made by spring members. The flexible circuit trails rearwardly from the connector. This arrangement is believed exemplified in the connectors disclosed in U.S. Pat. Nos. 3,897,130 (Donnelley), 3,941,448 (Evans), 4,248,491 (Mouissie, also assigned to the assignee of the present invention), 4,684,183 (Kinoshita et al.) or 4,714,436 (Jones).

Still another form of flexible circuit connector utilizes a spring loaded clip arrangement in which the clips are opened to accept the end of the flexible circuit. When released the spring clips clamp the flexible circuit to the member to which it is to be interconnected. Representative of such connectors are those disclosed in U.S. Pat. Nos. 4,111,510 (Zurcher) or 4,252,389 (Olsson).

Yet another flexible circuit connector utilizes generally C-shaped spring clips in which the flexible circuit is brought to the connector from the closed end of the C-shaped clip.

The flexible circuit is looped around the arms of the clip and the ends of the flexible circuit enters between the open ends thereof. The connectors disclosed in U.S. Pat. Nos. 3,614,707 (Zurcher), 4,416,497 (Brandsness et al.), 4,621,882 (Krumme), or Japanese Patent 3,069,171 (Fujitsu) are believed representative of this form of connector. Such an arrangement may be disadvantageous inasmuch as the looping of the flexible circuit may engender stress in the conductive tracings thereon, leading to premature cracking of the material of the tracings.

SUMMARY OF THE INVENTION

The present invention relates to a zero insertion force connector and and a zero insertion force interconnection system for interconnecting conductive tracings oh at least one, but preferably a pair, of flexible circuits to corresponding electrical conductive paths on respective surfaces of a substrate.

The zero insertion force connector comprises a first and a second spring clamp jaw, each spring clamp jaw having a forward end and a rearward end thereon. Each flexible circuit is attached to one of the clamp jaws adjacent the forward end thereof. The clamp jaws are confrontationally arranged so that a portion of each clamp jaw adjacent to the rearward end thereof cooperate to define a channel through which the flexible circuits pass. In the preferred case the flexible circuits each have a region near the end thereof that is free of conductive tracings, and it is within this region that the flexible circuits are attached to the associated spring clamp jaw. Actuating means is provided for opening the spring clamp jaws to space the forward ends thereof apart a distance greater than the thickness dimension of the substrate, thereby to permit the conductive tracings on the flexible circuits into registration with the conductive paths on respective surfaces of the substrate.

Each of the spring clamp jaws has a concave portion intermediate the forward and the rearward ends thereof. Tile actuating means lies within the concave portion of the confrontationally arranged spring clamp jaws. In the preferred instance the actuating means comprises a first and a second actuator, with each actuator being respectively disposed within the concave portion of a respective one of the spring clamp jaws. Each actuator includes a bearing member having a bearing surface thereon, a rod rotationally received on the bearing surface, and an actuating handle for rotating the rod with respect to the bearing surface. Each rod has an actuating surface with an actuating edge defined thereon. Rotation of the rod by depressing the handles manually or with a remotely controlled device brings the actuating edge thereon into lifting engagement against the lifting surface on the concave portion of the spring clamp jaw within which it is disposed, thereby to impose an opening force on the spring clamp jaw to open the same against its spring bias. The opening of the spring clamp jaws urging the clamp jaws to the closed position. Preferably each of the actuating rods has a camming surface thereon.

The zero insertion force connector system additionally includes a fixture with respective upper and lower abutment edges thereon. In the preferred instance the fixture has a transition platform with conductive landings provided on both surfaces thereof. The landings are electrically connected to the conductive paths on respective surfaces of the substrate. In addition to generating the restoring force in the spring clamp jaws, rotation of the actuating rods presents the camming surface on each rod to the respective abutment edge on the fixture. When the connector is about to be joined to the fixture, the abutment edges on the fixture and the camming surfaces on the rods are engaged such that a relative movement occurs therebetween in a rearward direction (i.e., toward the connector) in response to the restoring force in the spring jaws of the connector or to the restoring force provided by the remotely controlled device. This relative motion generates a wiping motion between the conductive landings on each surface of the transition platform of the fixture and the conductive tracings on each flexible circuit. The transition platform may be omitted, if desired, and the fixture attached directly to the substrate. In such an instance, the wiping action as above described is generated directly between the conductive paths on each surface of the substrate and the conductive tracings on each flexible circuit.

To insure registration between the tracings on the flexible circuits and the respective conductive landings on the transition platform (or the respective conductive paths on the substrate, if the fixture is omitted), both of the spring clamp jaws carry at least one positioning pin adjacent the forward end thereof. In addition, the fixture has an upper and a lower positioning ridge adjacent to each surface of the transition platform (or substrate, as the case may be). The positioning pin on each spring clamp jaw and its corresponding positioning ridge on the fixture are engageable to locate each spring clamp jaw with respect to the transition platform (or substrate) so that the conductive tracings on each flexible circuit register with the conductive landings (or conductive paths) on the corresponding surface of the transition platform (or substrate, as the case may be). Preferably, the positioning ridges are generally wedge-shaped, with the tip of the wedge pointing toward the spring clamp jaws and aligning with the rearward direction of the wiping motion. The positioning engagement between the positioning pins on the spring clamp jaws and the positioning ridges on the fixture occurs simultaneously with the generation of the wiping action.

BRIEF DESCRIPTION OF THE DRAWINGS

The invention will be more fully understood from the following detailed description thereof taken in connection with the accompanying drawings, which form a part of this application and in which.

DETAILED DESCRIPTION OF THE INVENTION

Figure 1:
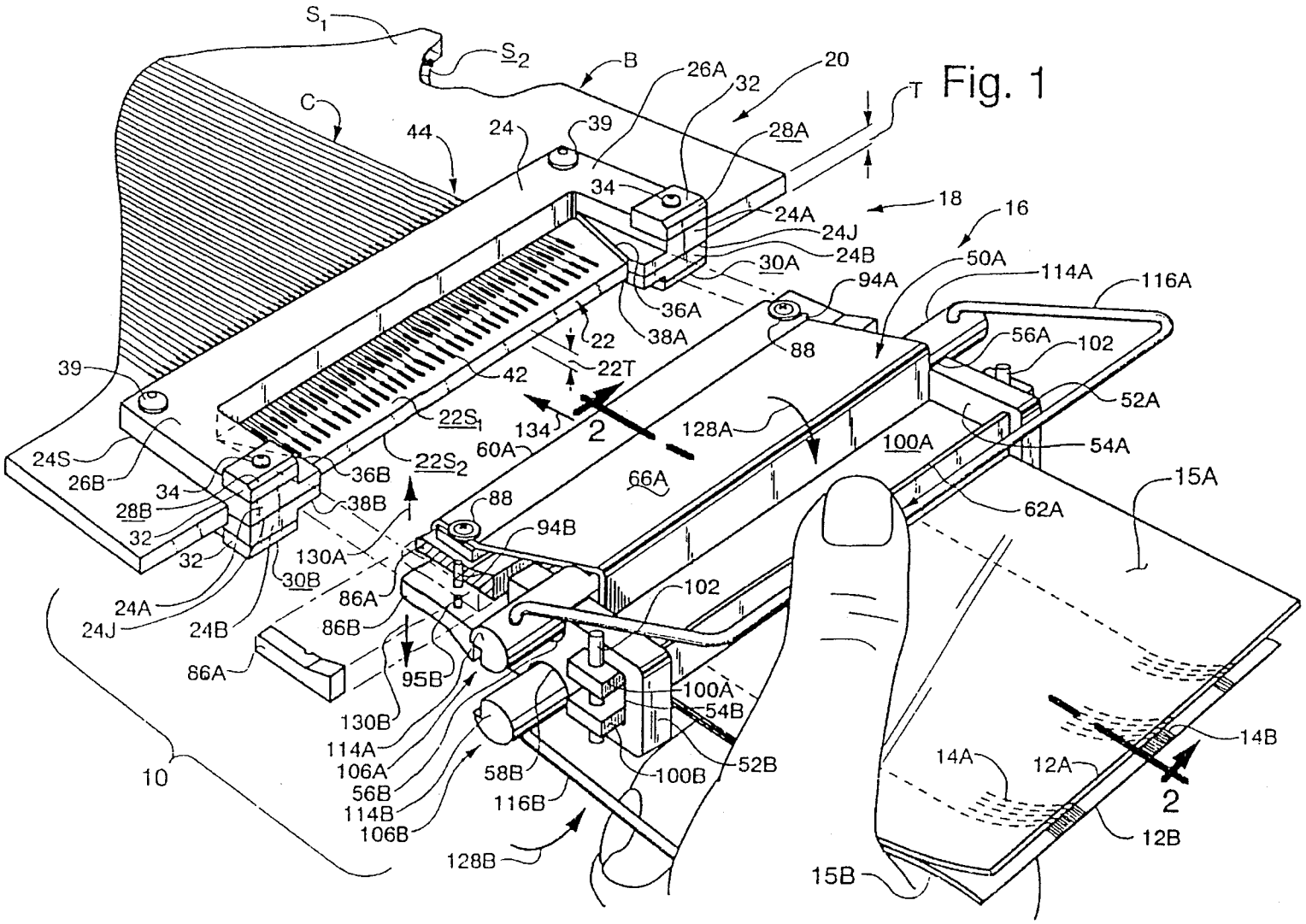
FIG. 1 is a perspective view of a zero insertion force connector system in accordance with the present invention for interconnecting conductive tracings on at least one flexible circuit to conductive paths on a substrate, with the clamping connector of the connector system about to be placed into operative association with a cooperating fixture secured to the substrate, portions of elements of the connector system being broken away for clarity of illustration.

Throughout the following detailed description similar reference numerals refer to similar elements in all figures of the drawings.

With reference to FIG. 1 shown is a perspective view of a zero insertion force flexible circuit connector system generally indicated by the reference character 10 in accordance with the present invention. The connector system 10 is adapted to bring conductive tracings 14A disposed in a predetermined pattern on an operative surface of at least one flexible circuit 12A into electrical contact with conductive paths C disposed on a corresponding respective surface $S_1$ of a substrate B, such as a rigid circuit board. It should be understood that although the substrate is shown in the Figures as a rigid circuit board, it lies within the contemplation of the invention for the substrate B to take the form of another flexible circuit. More preferably, the connector system 10 is adapted to bring conductive tracings 14A, 14B respectively disposed in a predetermined pattern on respective operative surfaces of each of a pair of flexible circuits 12A, 12B into electrical contact with conductive paths C disposed on a corresponding respective surfaces $S_1$, $S_2$ of the substrate B. The board B has a thickness dimension T associated therewith. As is appreciated by those with skill in the art, the opposite surface 15A, 15B of one or both of the respective flexible circuits 12A, 12B may also have conductive traces (not shown) thereon which may, for example, carry ground currents. The ground traces can be connected through vias (not shown) to the traces 14A, 14B, respectively, on the first surfaces of the flexible circuits 12A, 12B, respectively, or can be connected directly to the respective clamp jaws 50A, 50B.

The connector system 10 in accordance with this invention comprises a clamping connector member generally indicated by the reference character 16 and a cooperating fixture 18. The flexible circuits 12A (and 12B, if used) is(are) attached to the clamping connector 16 in a manner to be described, while the fixture 18 is attached to the substrate B.

In the most generalized embodiment, the fixture 18 includes a frame 20 supporting a transition platform 22. Preferably the frame 20 is a generally C-shaped member formed of a metallic material, although it may be fabricated from a suitable nonconductive material if desired. The frame 20 includes a main body portion 24 from which project extending arms 26A, 26B. The upper and lower surfaces of the end of the arm 26A are each provided with abutment surfaces 28A, 30A, while the upper and lower surfaces of the end of the arm 26B is similarly provided with abutment surfaces 28B, 30B. As illustrated in the Figures the abutment surfaces 28A, 28B, 30A, 30B may be defined on inserts 32 secured to the arms 26A, 26B by any suitable expedient (such as the screws 34). Alternatively, however, the abutment surfaces 28A, 28B, 30A, 30B may be directly formed on the ends of the arms 26A, 26B. The purpose of the abutment surfaces 28A, 28B, 30A, 30B will become more clear herein. The confronting lateral surfaces of the arms 26A, 26B are provided with an upper pair of positioning ridges 36A, 36B. In the preferred instance the arms 26A, 26B are similarly provided with a lower pair of positioning ridges 38A, 38B. The upper and lower pairs of positioning ridges are provided for a purpose to be later described.

In the preferred instance, the transition platform 22 is defined by the forward end region of the substrate B. In this event, the body portion 24 of the frame 20 is formed by upper and lower body sections 24A, 24B joined along a line of joinder 24J and secured together by screws 39. Alternatively, the transition platform 22 may be formed from an insulated substrate member separate from the substrate B, in which event an integrally formed body portion 24 is slotted, as as 24S, whereby the substrate B may be edgewise engaged to the frame 20. Any suitable expedient may be used to secure the substrate B to the frame 20, with screws 39 again being illustrated for this purpose. The more general case in which the transition platform 22 is a member separate from the substrate B is discussed hereinafter.

The transition platform 22 is attached to the inner edge surfaces of the body 24 and of the arms 26A, 26B of the frame 20. When the transition platform 22 is formed of an insulating material, one or both of the surfaces $22S_1$, $22S_2$ of the transition platform 22 is provided with conductive landings 42. The landings 42 may be arranged in any convenient pattern, with a two-row, staggered relationship being illustrated. The pattern of the landings 42 on the surfaces $22S_1$, $22S_2$ of the transition platform 22 respectively matches the pattern of the tracings 14A, 14B on the flexible circuits 12A, 12B. The transition platform 22 has a thickness dimension 22T associated therewith.

The upper pair of positioning ridges 36A, 36B are adjacent to and communicate with the upper surface $22S_1$ of the transition platform 22. Analogously, the lower pair of positioning ridges 38A, 38B are adjacent to and communicate with the lower surface $22S_2$ of the transition platform 22. The ridges in each pair are arranged to lie in a generally wedge-like, or V-shaped, configuration, with the apex of the wedge (i.e., the point of the V shape) being directed toward the clamping connector member 16.

To effect the interconnection of the landings 42 with the conductive paths C on the surface $S_1$ of the substrate B at least a first array of spring contact fingers 44 extends rearwardly from the body 24 of the frame 20. The inward end of each of the spring contact fingers in the array 36 is disposed in electrical contact with a landing 42 on the first surface $22S_1$ of the transition platform 22. Of course, in the preferred case, since landings 42 are also provided on the other surface $22S_2$ of the transition platform 22, a second array of spring contact fingers (not visible in the Figures) is provided to interconnect the landings 42 on the second surface $22S_2$ of the transition platform 22 with the conductive paths on the second surface $S_2$ of the substrate B.

It should be noted that the transition platform 22 may be eliminated and the fixture 18 be directly mounted to the substrate B. In such an instance the resulting arrangement is generally similar to that shown in FIG. 1, with a portion of the substrate B then being disposed between the arms 26 of the frame 20. The ridges 36A, 36B in the upper ridge pair would then lie adjacent to the upper surface $S_1$ of the substrate B, while the ridges 38A, 38B in the lower ridge pair would then lie adjacent to the lower surface $S_2$ of the substrate B. A suitable arrangement may be necessary to insulate the fixture 18 from the conductive paths on the surfaces $S_1$, $S_2$ of the substrate B in the event the fixture is fabricated from a conductive material.

Figure 2:
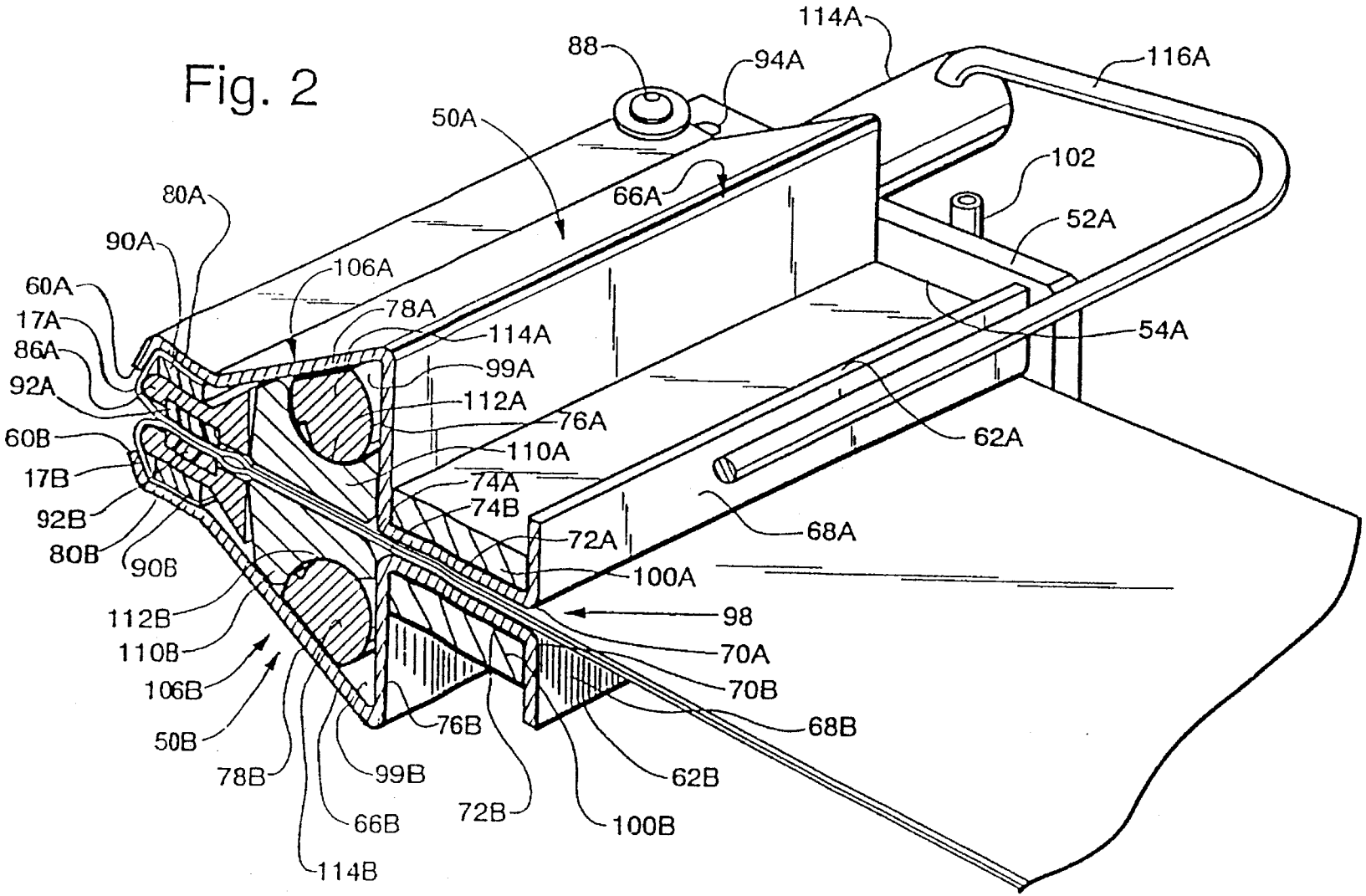
FIG. 2 is a sectional perspective view of the clamping connector of the zero insertion force flexible circuit connector system shown in FIG. 1 taken along section lines 2—2 therein.

The clamping connector 16 is illustrated FIGS. 1 and 2. The clamping connector 16 is formed from a first, upper, and a second, lower, spring clamp jaw 50A, 50B, respectively. The clamp jaws are confrontationally disposed and are captured between a pair of side plates 52A and 52B. Each side plate 52A, 52B has a window 54A, 54B formed therein. (The window 54B is not visible in FIG. 2.) The upper edge of each of the side plates 52A, 52B is provided with a generally semicircular cutout 56A, 56B. A corresponding generally semicircular lower cutout 58A, 58B is provided in the lower edge of each of the side plates 52A, 52B. Again, owing to the perspective, the cutout 58A is not seen in FIGS. 1 and 2.

Generally speaking, in the preferred implementation each of the spring clamp jaws 50A, 50B has a first, forward, end 60A, 60B, respectively, and a second, rearward, end 62A, 62B respectively, thereon. Moreover, each of the spring clamp jaws 50A, 50B has a concave region 66A, 66B defined intermediate the respective forward ends 60A, 60B, and respective rearward ends 62A, 62B. The concave regions 66A, 66B are arranged in confrontational relationship with respect to each other.

More particularly, with reference to FIG. 2, it may be seen that each spring clamp jaw 50A, 50B includes (beginning at the rearward end 62A, 62B thereof) a tail section (68A, 68B) bent at a line of bending (70A, 70B) from an adjacent linear section (72A, 72B). The linear section (72A, 72B) itself turns at a line of bending (74A, 74B) to form a linear backwall section (76A, 76B) that melds into a planar lifting wall section (78A, 78B). The backwall section (76A, 76B) and the lifting wall section (78A, 78B) together define the concave regions (66A, 66B) of the spring clamp jaws. The planar lifting wall section (78A, 78B) itself melds into a forward flange section (80A, 80B) that is terminated by a turned lip section (82A, 82B). The lip section (82A, 82B) lies at the forward edge 60A, 60B of the respective spring clamp jaws 50A, 50B. As noted earlier, if ground traces are provided on the opposite surfaces 15A, 15B of one or both of the flexible circuits 12A, 12B, such ground traces may be conveniently connected to the clamping jaw by direct contact to the linear section 72A, 72B or a point near the forward end 60A, 60B of the respective jaw 50A, 50B.

The undersurfaces of the flange sections 80A, 80B of the spring clamp jaws 50A, 50B each receive an anvil 86A, 86B. The anvils are secured to their respective spring clamp jaw 50A, 50B by a screw 88. A brace bar 90A, 90B (FIG. 2) is disposed between the one surface of each anvil 86A, 86B and the surface of the proximal flange sections 80A, 80B. The other surface of each anvil 86A, 86B is provided with load distributing elastomeric pad 92A, 92B. The ends of the anvils 86A, 86B extend laterally past the side edges of the spring clamp jaw 50A, 50B to which they are mounted, and thus laterally past the side edges of the spring clamp jaws 50A, 50B.

The laterally extending portion at each end of the anvil 86A has a respective positioning pin 94A, 94B thereon. Similarly, the laterally extending portion at each end of the anvil 86B has a positioning pin 95A, 95B. As will be developed, the positioning pins 94A, 94B interact with the upper pair of positioning ridges 36A, 36B to position the tracings 14A on the flexible circuit 12A with respect to the landings 42 on the surface $22S_1$ of the transition platform 22 (if it is used) or, alternatively, with the conductive paths on the surface $S_1$ of the substrate B, if the platform 22 is omitted. In like manner, the positioning pins 95A, 95B are arranged to cooperate with the lower pair of positioning ridges 38A, 38B on the frame 20 of the fixture 18 thereby to position the tracings 14B on the flexible circuit 12B (if used) with respect to the landings 42 on the surface $22S_2$ of the transition platform 22 (if present) or, alternatively, with the conductive paths on the surface $S_2$ of the substrate B.

In the assembled condition the spring clamp jaws 50A, 50B of the clamping connector member 16 are arranged between the side plates 52A, 52B. The confronting linear sections 72A, 72B of the spring clamp jaws 50A, 50B are spaced apart and thus cooperate to define a channel 98. The concave regions 66A, 66B are also confrontationally disposed, thereby to define an actuator receiving chamber 99A, 99B disposed beneath the respective spring clamp jaws 50A, 50B.

The spring clamp jaws 50A, 50B of the clamping connector member 16 are secured together by an upper and a lower transversely extending beam 100A, 100B. Each beam 100A, 100B lies between the exterior surface of the tail section 68A, 68B and the exterior surface of backwall section 76A, 76B of one its respective associated spring clamp jaw. When so positioned the jaws are held together by the action of each beam 100A, 100B acting against the exterior surface of the respective linear section 72A, 72B of one of the spring clamp jaws 50A, 50B. The ends of the beams 100A, 100B extend through the windows 54A, 54B in the side plates 52A, 52B. Adjacent lateral ends of the beams 100A, 100B are connected to each other by a post 102 at a point on the beams 100A, 100B just laterally past the end plates 52A, 52B, thus preventing the ends of the beams 100A, 100B from sliding out of the plates 52A, 52B. The beams may, alternatively, take the form of a U-shaped member, with one end of each of the tines of the member being integrally joined (and having exterior raised abutments to act against the lateral outside surface of one side plate). The other end of the tines are connected using a pin, similar to the arrangement shown in FIG. 1.

Each of the flexible circuits 12A, 12B passes through the channel 98. The conductive tracings 14A, 14B on the respective flexible circuits 12A, 12B do not extend into a region 17A, 17B adjacent to the ends of the respective flexible circuits 12A, 12B. These end regions 17A, 17B of the respective flexible circuits 12A, 12B that are free of conductive tracings are attached to the spring clamp jaws 50A, 50B, respectively. The end regions 17A, 17B preferably extend between and are captured by the undersurface of the jaws 50A, 50B and the confronting surface of the associated respective brace bar 90A, 90B. This arrangement is illustrated in FIG. 2. However, as is illustrated in the FIGS. 3A through 3C and 4A, the end regions 17A, 17B should extend at least between the forward edge of the anvil 86A, 86B and the undersurface of the lip section 82A, 82B of each spring clamp jaws 50A, 50B. The point to note is that since the attachment of the flexible circuit to its respective jaw occurs in a region free of conductive tracings, damage to the tracings is not a consideration in a clamping connector in accordance with the present invention.

The clamping connector member 16 further includes actuating means 106, disposed in the actuator receiving chambers 99A, 99B provided respectively beneath the concave regions 66A, 66B of the jaws 50A, 50B, for opening the clamp jaws to space the forward ends 60A, 60B thereof apart a predetermined distance 108. In the implementation shown the distance 108 is measured between the tips of the positioning pins 94A, 94B (and, similarly, the the positioning pins 95A, 95B) and must be at least greater than the thickness dimension 22T of the transition platform 22. If the platform is omitted the distance 108, measured between the tips of the positioning pins 94A, 94B, must at least equal the thickness dimension T of the substrate B. Opening the jaws 50A, 50B also spaces apart the operative surfaces of the flexible circuits 12A, 12B in the vicinity of the forward end of the connector.

The actuating means 106 comprises a first and a second actuator 106A, 106B. The actuator 106A comprises a bearing block, or cradle, 110A having a generally cylindrically contoured bearing surface 112A thereon, a generally cylindrical elongated camming rod 114A, and an actuating handle 116A attached to the camming rod 114A. The actuator 106B is similarly configured, and includes a bearing block, or cradle, 110B with a generally cylindrically contoured bearing surface 112B thereon, a generally cylindrical elongated camming rod 114B with an actuating handle 116B attached thereto.

Each bearing block 110A, 110B is respectively received in the chamber 99A, 99B beneath the respective concave region 66A, 66B of the spring clamp jaw 50A, 50B, as the case may be. Each block 110A, 110B is trapped between the rearward edge of the anvil 86A, 86B and the inner surface of the respective backwall section 76A, 76B of its associated spring clamp jaw. The bearing blocks 110A, 110B are laterally confined by the side plates 52A, 52B.

Each camming rod 114A, 114B is supported over the majority of its axial length by the bearing surface 112A, 112B on a respective one of the bearing blocks 110A, 110B. The lateral end of each camming rod 114A, 114B extends through the corresponding cutouts 56A, 58A and 58A, 58B in the side plates 52A, 52B. Each actuating handle 116A, 116B is connected to the ends of its associated camming rod 114A, 114B at points laterally past the side plates 52A, 52B.

Figure 3A:
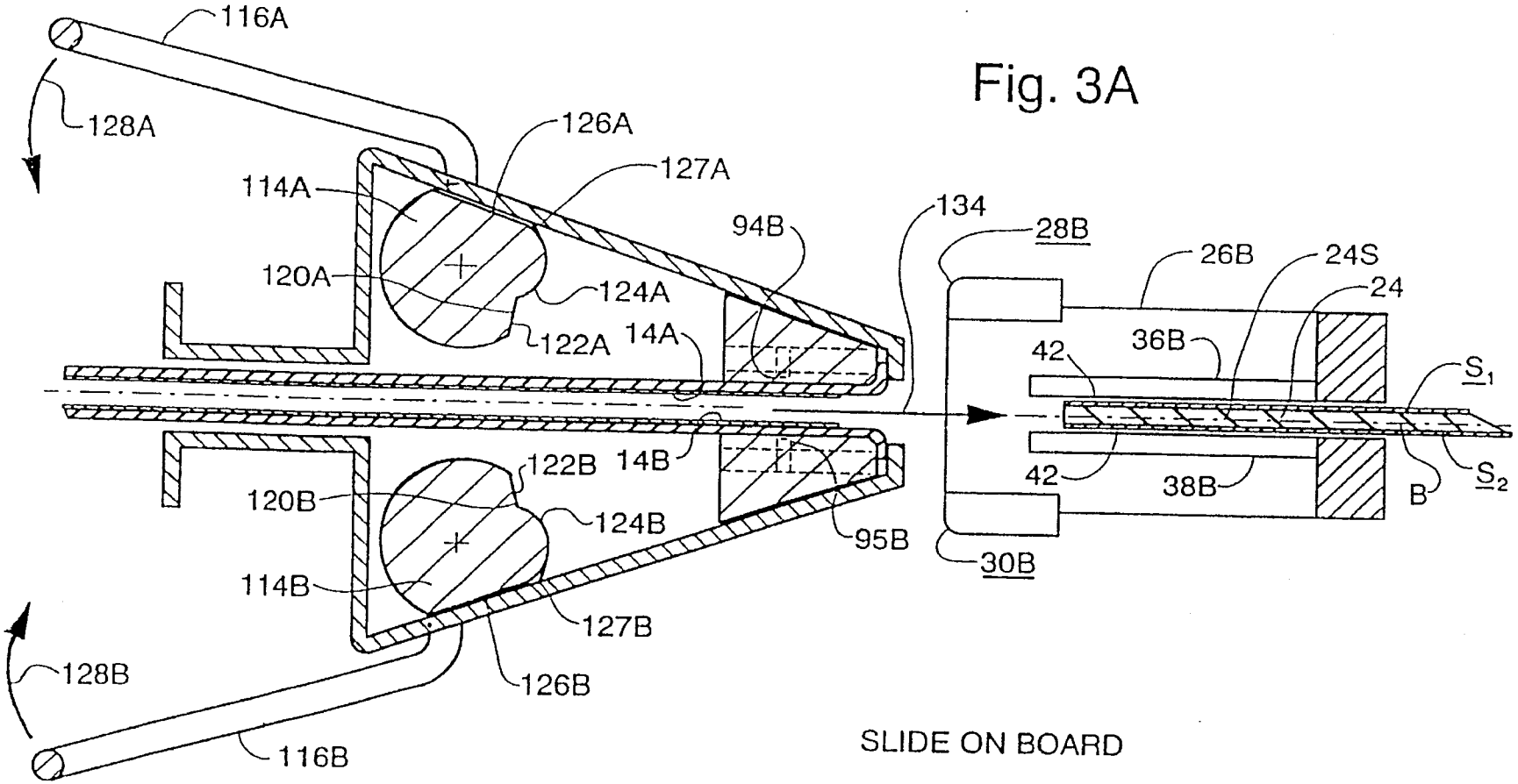
FIG. 3A through FIG. 3C are highly stylized pictorial representations illustrating steps during the mounting of the clamping connector to the cooperating fixture, these Figures particularly illustrating the generation of the wiping action between conductive tracings on the flexible circuit and conductive landings on the fixture; and, FIG. 4A through FIG. 4C are highly stylized elevational (FIG. 4A) or plan views (FIGS. 4B and 4C) respectively corresponding to FIGS. 3A through 3C, illustrating the registering action imparted by the interaction between positioning pins on the spring clamp jaws., of the connector of the present invention and corresponding positioning ridges on the fixture, thereby to position the conductive tracings on the flexible circuit and conductive landings on the fixture simultaneously with the generation of the wiping action.

As may be perhaps best seen in FIG. 3A, each camming rod 114A, 114B has an axially extending notch 120A, 120B, respectively formed therein. The notches 120A, 120B are respectively defined by a generally planar surface 122A, 122B that communicates with a respective cam surface 124A, 124B. Further, the camming rods 114A, 114B are each provided with an axially extending lifting surface 126A, 126B each of which has a respective axially extending edge 127A, 127B. As will be seen the edges 127A, 127B define the operative portions of the respective lifting surfaces 126A, 126B. The lifting surface 126A, 126B matches the contour of the undersurface of the lifting wall section 78A, 78B of the spring clamp jaw 50A, 50B with which the camming rod 114A, 114B is associated. In the preferred embodiment illustrated the contour of lifting surface 126A, 126B and the undersurface of the lifting wall section 78A, 78B are both planar, although these surfaces may take other configurations and lie within the contemplation of the present invention.

Having described the structure of the connector system in accordance with the present invention, it is believed that the operation thereof may now be readily understood from the highly schematic side elevational and plan views shown in FIGS. 3A through 3C and FIGS. 4A through 4C.

Figure 4A:
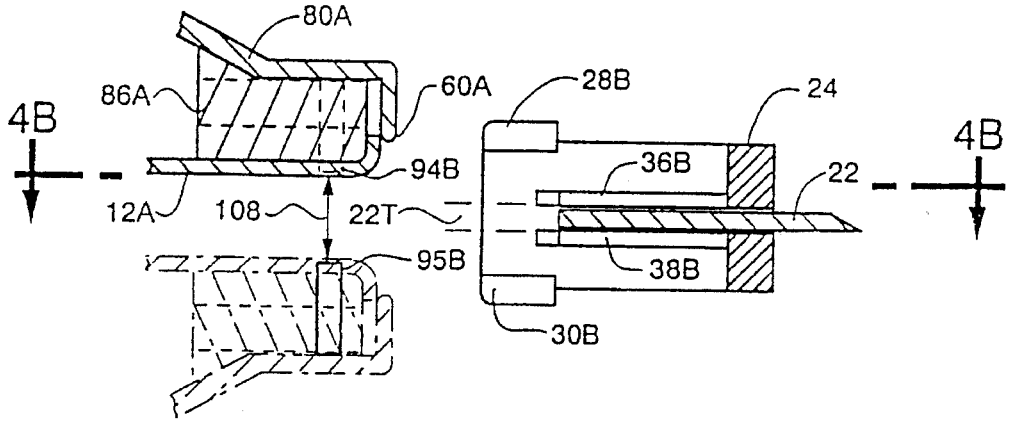

In FIG. 3A, respective movement of the actuating handles 116A, 116B in the directions 128A, 128B brings the edges 127 A, 127B of the lifting surfaces 126A, 126B on the camming rods 114A, 114B, respectively, into lifting engagement with the undersurface of the planar lifting wall section 78A, 78B of the clamp jaws 50A, 50B. Thus, the rotational motion of each camming rod 114A, 114B about its axis is converted a lifting action which opens the clamp jaws 50A, 50B against their spring bias and imparts opposed vertical opening motions to the anvils 86A, 86B in the directions of the arrows 130A, 130B (FIG. 1). The tips of the confronting pairs of positioning pins 94A, 95A and 94B, 95B respectively disposed on the anvils 86A, 86B, are thus spaced by at least the gap distance 108 (FIG. 4A). The flexible circuits 12A, 12B respectively attached to the jaws 50A, 50B are spaced apart as well.

As noted earlier, the required magnitude of the distance 108 depends upon the operational environment in which the clamping connector member 16 is being used. In the event that the clamping connector member 16 is being directly attached to a substrate B without the benefit of the fixture 18, or if the fixture 18 is being used without the transition platform 22, the distance 108 must at least equal the thickness dimension T of the substrate B (whether that substrate B is being implemented by a flexible circuit or a circuit board). However, when the clamping connector member 16 is being used with the cooperating fixture 18 having a transition platform 22 therein, the gap distance 108 must at least equal the thickness dimension 22T of the transition platform 22.

Figure 3B:
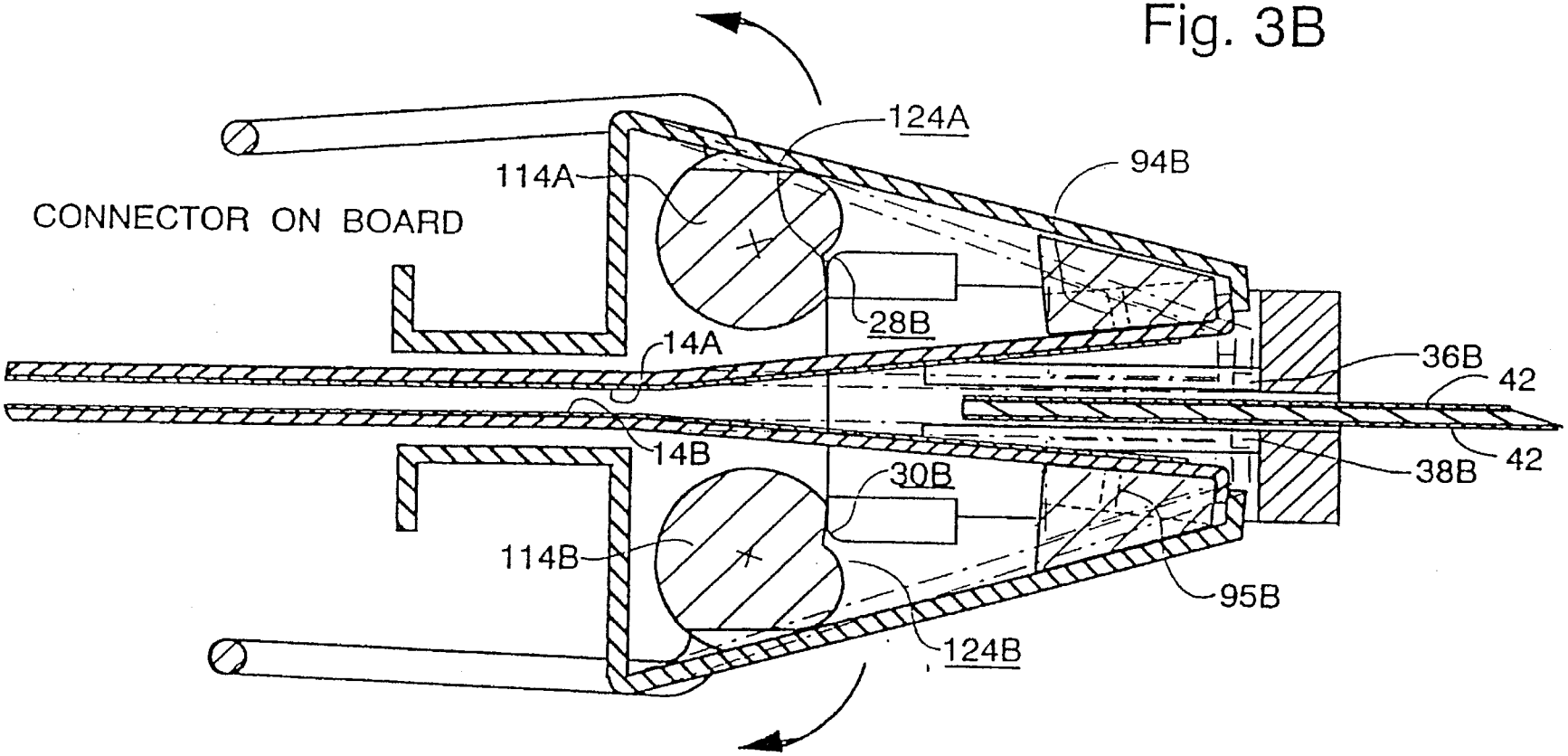

As may best be appreciated frown FIGS. 3A and 3B, rotation of the rods 114A, 114B also has the effect of presenting a respective lateral end of the notch 120A on the rod 114A toward the upper abutment edges 28A, 28B (on the arms 26A, 26B, respectively) and a respective lateral end of the notch 114B toward the lower abutment edges 30A, 30B (on the arms 26A, 26B, respectively). The confrontation of the notch 120A, 120B with the surfaces 28A, 30A is illustrated in FIG. 3B.

Figure 4B:
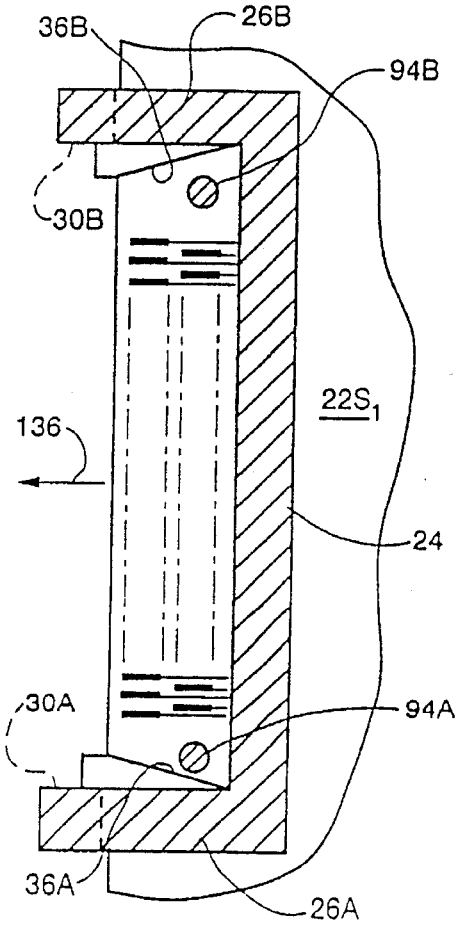

With the spring clamp jaws 50A, 50B still opened such that the confronting pairs of positioning pins 94A, 95A and 94B, 95B on the anvils 86A, 86B are spaced apart the gap distance 108, the connector 18 is advanced forwardly, in the direction of the arrow 134 (FIGS. 1, 3A, 3B, 4A, 4B), toward the transition platform 22. Forward advancement of the clamping connector member 16 toward the fixture 20 continues until the notches 120A, 120B on the camming rods 114A, 114B respectively engage against the upper camming edges 28A, 28B and the lower camming edges 30A, 30B (FIG. 3B). In this disposition the tracings 14A, 14B on the flexible circuits 12A, 12B respectively vertically register with the landings 42 on the upper and lower surfaces $22S_1$, $22S_2$ of the transition member 22. It should be readily appreciated that such registration cannot be achieved unless the patterns of the tracings are matched. As will be more fully discussed hereinafter, at the time the engagement between the camming surfaces and the edges illustrated in FIG. 3B is made, the upper and lower pairs of positioning pins on the spring clamp jaws have also been brought to a position where the pins lie within the confines of the wedge shaped configuration of the positioning ridges. This relationship is illustrated in FIG. 4B for the case of the upper pair of positioning pins 94A, 94B and the upper positioning ridges 36A, 36B.

Release of the actuating handles 116A, 116B permits the restoring force due to the bias of the opened spring clamp jaws 50A, 50B to become dominant. The jaws close, in directions 132A, 132B (FIG. 3C, these directions being counter to the opening directions 128A, 128B). The undersurfaces of the lifting wall sections 78A, 78B of the respective clamp jaws 50A, 50B act against the respective edges 127A, 127B of the lifting surfaces 126A, 126B on the rods 114A, 114B, causing the same to rotate about their axes. As the spring clamp jaws are closed, the tracings on the flexible circuit 12A, 12B are placed on the landings 42 on the respective surfaces $22S_1$, $22S_2$ of the transition platform 22.

Figure 3C:
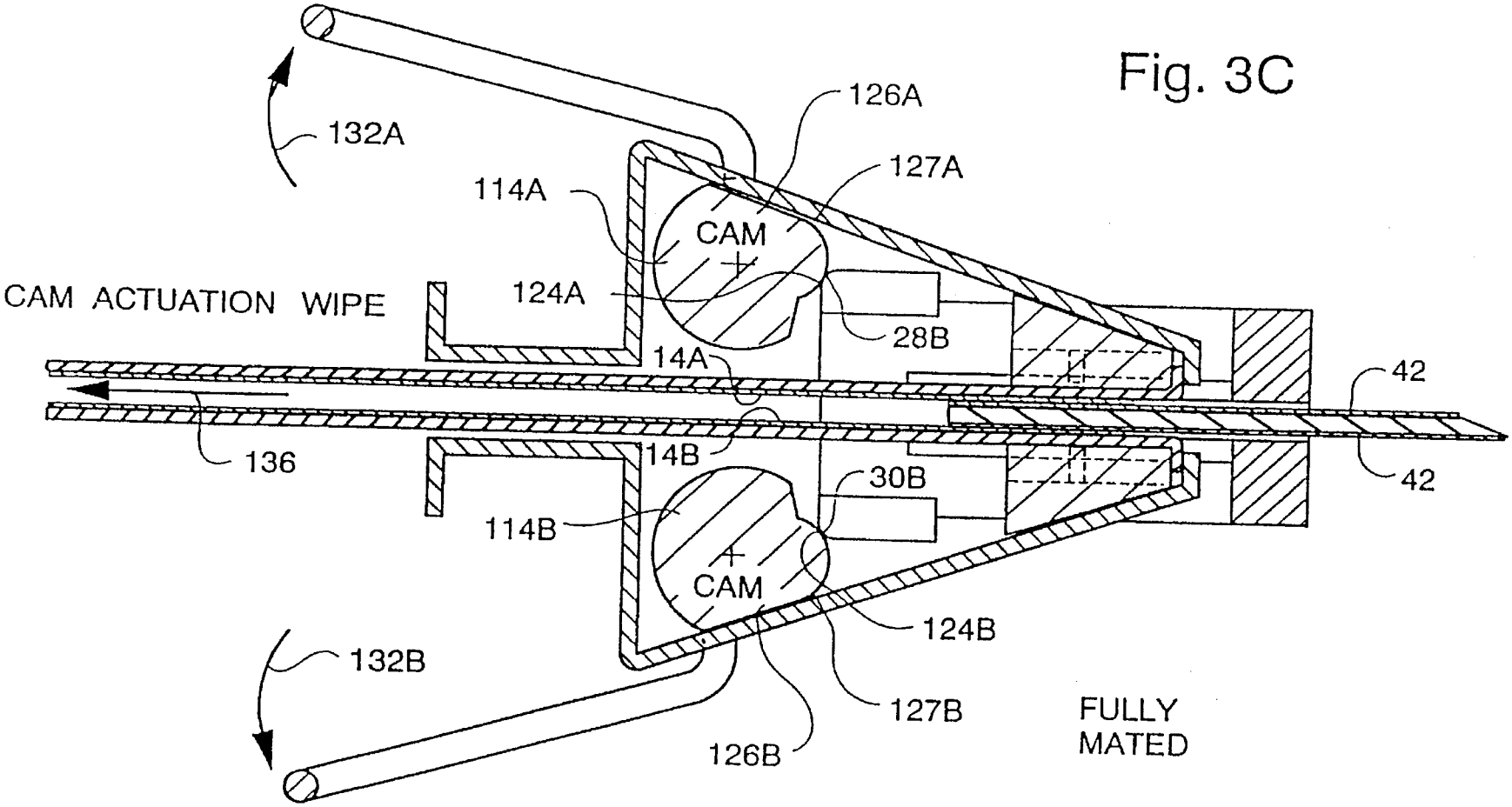

As may be seen in FIG. 3C, the rotation of the camming rods 114A, 114B in these counter directions 132A, 132B brings the cam surface 124A on the rod 114A into operative engagement with the abutment edges 28A, 28B and the cam surface 124B on the rod 114B into operative engagement with the abutment edges 30A, 30B. The reaction between the cam surfaces and the abutment edges in response to the restoring force of the spring jaws imposes a force on the connector tending to move the same in the direction of the arrow 136, that is, in a direction rearwardly with respect to the connector 16. This motion of the clamping connector member 16 in the direction 136 provides a wiping action in the direction 136 between the tracings 14A, 14B on the flexible circuits 12A, 12B and the corresponding landings 42 on the respective surfaces $22S_1$, $22S_2$ of the transition platform 22.

Figure 4C:
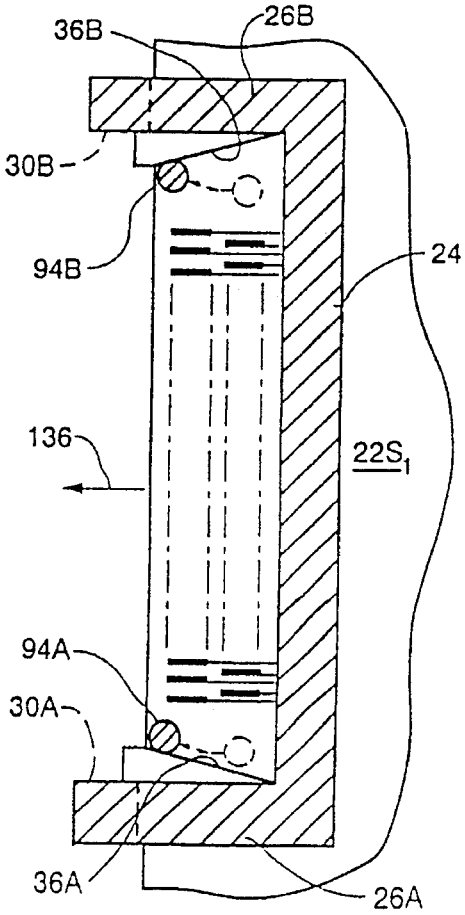

The generation of the wiping action in the direction 136 has the simultaneous effect of self-aligning the tracings 14A, 14B on the flexible circuits 12A, 12B and the corresponding landings 42 on the respective surfaces $22S_1$, $22S_2$ of the transition platform 22. The alignment is derived from the interaction between a pair of positioning pins on one of the anvils and the corresponding pair of positioning ridges on the fixture. As is best seen in FIG. 4C, as the wiping action in the direction 136 is caused to occur, one of the positioning pins in the pair of pins 94A, 94B, (e.g., the pin 94A), is brought into abutting contact with one of the ridges 36A, 36B (e.g., the ridge 36A) in the upper ridge pair. As the pin moves in the wiping direction 136 and rides along the ridge 36A the constricting action imparted by the wedge shaped configuration of the ridges 36A, 36B serves to laterally shift the jaw 50A on which the pins 94A, 94B are disposed. Thus the appropriate ones of the tracings 14A on the flexible circuit 12A are caused to register with the corresponding landings 42 on the surface $22S_1$ of the transition platform 22. A similar registering action is engendered on the lower surface $22S_2$ of the platform 22, owing to the interaction between the pair of pins 95A, 95B and the ridges 38A, 38B in the lower ridge pair. It is, of course, to be understood that the same registering action between the positioning pins and the positioning ridges may occur in the event the platform 22 is omitted.

Those skilled in the art, having the teachings of the present invention as hereinabove set forth, may effect numerous modifications thereto. For example, it is again noted that the clamping connector member 16 may find utility when only a single flexible circuit 12A is disposed on the clamping connector member 16. Further, also as noted earlier, the clamping connector member 16 may be used to directly connect tracings on one, or both, of the flexible circuits(s) directly to tracings on one, or both, surfaces of the substrate B. Moreover, if the fixture is used, thereby providing the benefits of the wiping action and the registering action discussed above, the fixture may be mounted directly to the substrate or may employ the transition platform, if desired. It should be appreciated that both the opening movement (i.e., in the direction 128) and/or the reverse movement of the actuating handles 116 (i.e., in the direction 132) may be imparted by a remotely controlled device, such as an air cylinder actuated from a remote location. This reverse movement of the actuating handles 116 may be used to cause the wiping action between the tracings discussed above. It should also be understood that these and such modifications lit within the contemplation of the present invention, as defined by the appended claims.

Figure 5A:
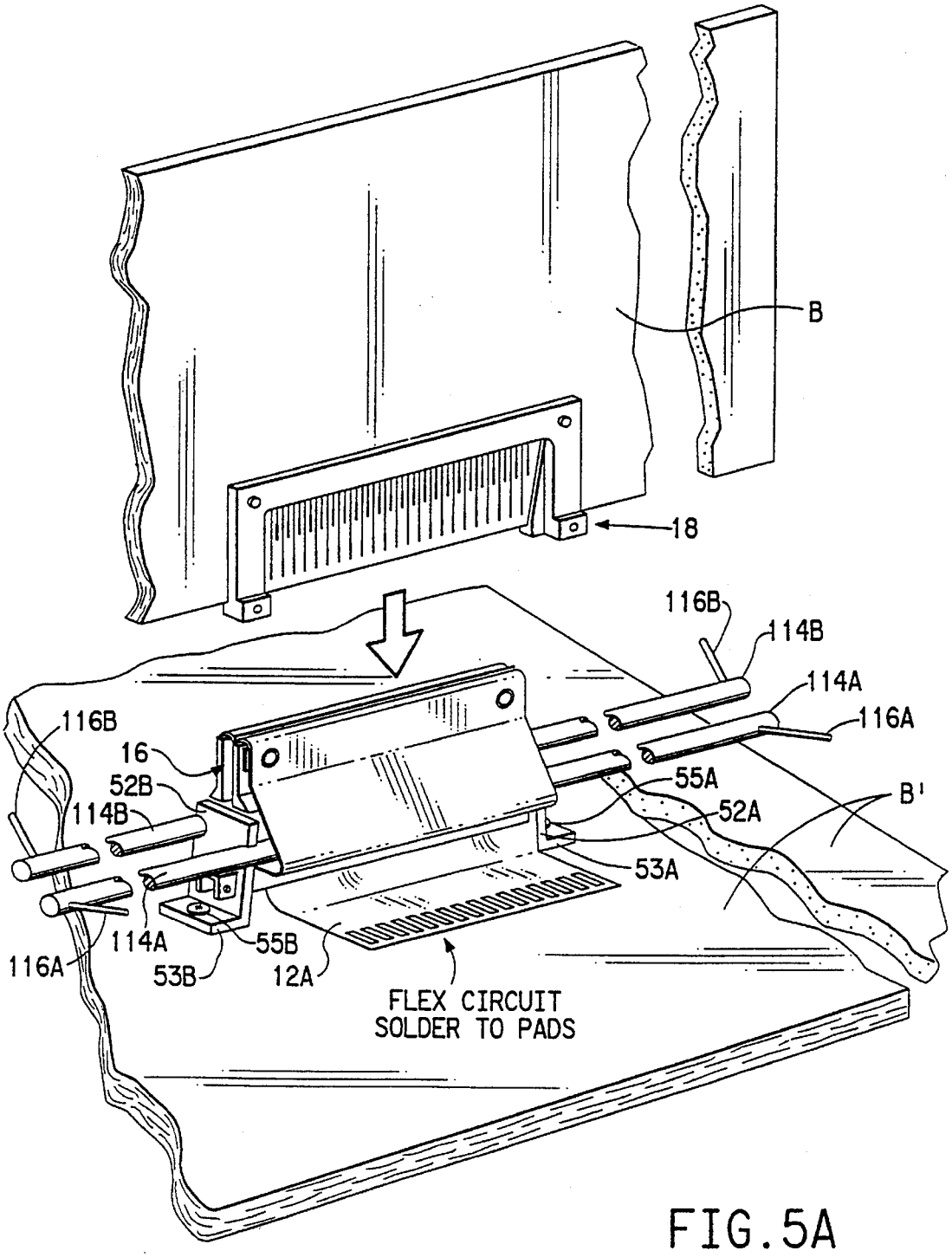
FIGS. 5A and 5B are perspective views illustrating the use of the connector system of the present invention in a board-to-board interconnection environment.
Figure 5B:
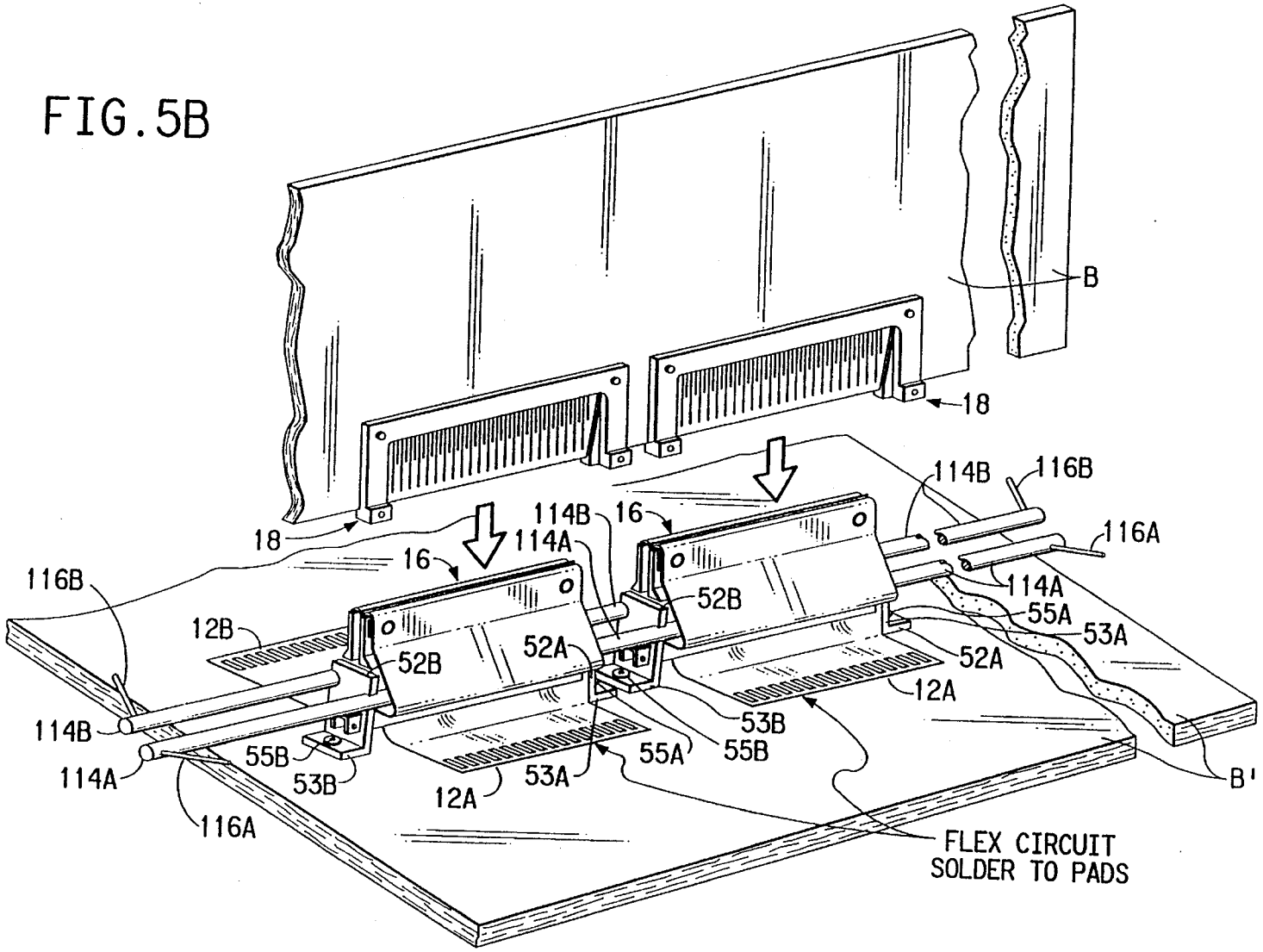

FIGS. 5A and 5B are perspective views illustrating the use of the connector system of the present invention in a board-to-board interconnection environment.

The connector system 10 of the present invention may also be used in an environment wherein one (or both) of the flexible circuits 12A, 12B is (are) themselves mounted to the surface of a rigid substrate (as a backplane or a motherboard) while the cooperating fixture 18 is attached to the board B (as a daughterboard). This board-to-board interconnection environment is illustrated in FIG. 5A (although the flexible circuit 12B is not visible due to the perspective of FIG. 5A). In FIG. 5A the flexible circuit 12A is soldered or otherwise suitably affixed to pads (not shown) disposed on the surface of a second substrate B'. The flexible circuit(s) 12A (and 12B, if provided) are attached to a clamping connector 16 in the manner discussed earlier herein. To facilitate this mounted disposition the extremities of the sideplates 52A, 52B of the clamping connector 16 are turned outwardly thereby to define mounting feet 53A, 53B. The feet 53A, 53B are suitably secured, as by respective screws 55A, 55B, to the substrate B'. The actuating handles 116A, 116B, are mounted in any convenient fashion to the respective ends of the camming rods 114A, 114B. Otherwise the structure and operation of the connector system 10 remains as discussed above.

The connector system 10 in accordance with this invention may also be used in a "ganged" fashion, as is illustrated in FIG. 5B. In this arrangement an array of paired (or single) flexible circuits 12A, 12B are again affixed to pads on the surface of the second substrate B'. Each flexible circuit (or pair thereof) 12A (and 12B, if provided) is (are) attached to a corresponding clamping connector 16. The clamping connectors 16 are in turn mounted to the substrate B', using the mounting feet 53A, 53B defined by the out-turned ends of the sideplates 52A, 52B. The fixtures 18 associated with each clamping connector 16 are mounted to the board B. In this arrangement it may be desirable to orient the clamping connectors 16 on the substrate B' such that the camming rods 114A, 114B of each connector 16 may be connected in common, as in an end-to-end fashion. Alternately, the camming rod 114A, 114B may be defined by a unitary member. The actuating handle 116A, 116B of the respective common camming rods 114A, 114B are again conveniently positioned.

What is claimed is:

1. A zero insertion force connector for interconnecting conductive tracings on at least a first flexible circuit to corresponding electrical conductive paths on a surface of a substrate, the substrate having a predetermined thickness dimension, the connector comprising:

a first and a second spring clamp jaw, each spring clamp jaw having a forward end and a rearward end thereon, the flexible circuit being attached to one of the clamp jaws adjacent to the forward end thereof, the clamp jaws being confrontationally arranged so that a portion of each clamp jaw adjacent to the rearward end thereof cooperate to define a channel through which the flexible circuit passes; and actuating means for opening the spring clamp jaws to space apart the forward ends thereof, wherein the flexible circuit has an end thereon and wherein the conductive tracings on the flexible circuit terminate a predetermined distance from the end of the flexible circuit thereby to define on the flexible circuit a region that is free of conductive tracings, the flexible circuit being attached to the forward end of the one spring clamp jaw within the region on the flexible circuit that is free of conductive tracings.

2. The connector of claim 1 wherein each of the spring clamp jaws has a concave region intermediate the forward and the rearward ends thereof, and wherein the actuating means lies within the concave region of the confrontationally arranged spring clamp jaws.

3. The connector of claim 1 wherein each of the spring clamp jaws has a concave region intermediate the forward and the rearward ends thereof, the concave region of each jaw having a lifting surface thereon, and wherein the actuating means comprises a first and a second actuator, each actuator being respectively disposed within the concave region of a respective one of the spring clamp jaws, each actuator comprising:

a bearing member having a bearing surface thereon, a rod rotationally received on the bearing surface, the rod having an actuating surface with an actuating edge defined thereon, and an actuating handle for rotating the rod with respect to the bearing surface to bring the actuating edge on the rod against the lifting surface on the concave region of the spring clamp jaw within which it is disposed thereby to impose an opening force on the spring clamp jaw to open the same against its spring bias.

4. The connector of claim 3 wherein the rod is a generally cylindrical, and wherein the lifting surface on the concave region of each of the spring clamp jaws and the actuating surface on each of the rods are generally planar.

5. The connector of claim 3 wherein at least one rod has a camming surface thereon, the connector further comprising a fixture with an abutment edge thereon, the fixture having a transition platform with conductive landings thereon, the conductive landings being electrically connected to the conductive paths on the substrate wherein rotation of the one rod to impose the opening force on its associated spring clamp jaw generates a restoring force in the spring clamp jaw and simultaneously presents the camming surface on the rod to the abutment edge on the fixture, the abutment edge and the camming surface being engageable such that relative movement therebetween in response to the restoring force in the spring clamp jaw generates a wiping motion acting in a predetermined wiping direction between the conductive landings on the fixture and the conductive tracings on the flexible circuit.

6. The connector of claim 5 wherein at least one spring clamp jaw has a positioning pin thereon, the positioning pin being disposed adjacent to the forward end thereof, and wherein the fixture has a positioning ridge thereon, the positioning pin on the one spring clamp jaw and the positioning ridge on the fixture being engageable to locate the one spring clamp jaw with respect to the fixture so that the conductive tracings on the flexible circuit register with the conductive landings on the fixture.

7. The connector of claim 6 wherein positioning ridge on the fixture is generally wedge-shaped, with the closed end of the wedge aligning with the wiping direction and extending toward the connector.

8. The connector of claim 3 wherein at least one rod has a camming surface thereon, the connector further comprising a fixture with an abutment edge thereon, wherein rotation of the one rod to impose the opening force on its associated spring clamp jaw generates a restoring force in the spring clamp jaw and simultaneously presents the camming surface on the rod to the abutment edge on the fixture, the abutment edge and the camming surface being engageable such that relative movement therebetween in response to the restoring force in the spring clamp jaw generates a wiping motion acting in a predetermined wiping direction between the conductive paths on the substrate and the conductive tracings on the flexible circuit.

9. The connector of claim 8 wherein at least one spring clamp jaw has a positioning pin thereon, the positioning pin being disposed adjacent to the forward end thereof, and wherein the fixture has a positioning ridge thereon, the positioning pin on the one spring clamp jaw and the positioning ridge on the fixture being engageable to locate the one spring clamp jaw with respect to the fixture so that the conductive tracings on the flexible circuit register with the conductive paths on the substrate.

10. The connector of claim 9 wherein positioning ridge on the fixture is generally wedge-shaped, with the closed end of the wedge aligning with the wiping direction and extending toward the connector.

11. The connector of claim 1 wherein at least one spring clamp jaw has a positioning pin thereon, the positioning pin being disposed adjacent to the forward end thereof, the connector further comprising a fixture attached to the substrate, the fixture having a positioning ridge thereon, the positioning pin on the one spring clamp jaw and the positioning ridge on the fixture being engageable to locate the one spring clamp jaw with respect to the fixture so that the conductive tracings on the flexible circuit register with the conductive paths on the substrate.

12. The connector of claim 11 wherein positioning ridge on the fixture is generally wedge-shaped, with the closed end of the wedge pointing toward the spring clamp jaws.

13. The connector of claim 1 wherein at least one spring clamp jaw has a positioning pin thereon, the positioning pin being disposed adjacent to the forward end thereof, the connector further comprising a fixture attached to the substrate, the fixture having a transition platform with conductive landings thereon, the conductive landings being electrically connected to the conductive paths on the substrate, the fixture also having a positioning ridge thereon, the positioning pin on the one spring clamp jaw and the positioning ridge on the fixture being engageable to locate the one spring clamp jaw with respect to the fixture so that the conductive tracings on the flexible circuit register with the conductive landings on the transition platform.

14. The connector of claim 13 wherein positioning ridge on the fixture is generally wedge-shaped, with the closed end of the wedge pointing toward the spring clamp jaws.

15. A zero insertion force connector for interconnecting conductive tracings on each of a first and a second flexible circuit to corresponding electrical conductive paths on respective first and second surfaces of a substrate, the substrate having a predetermined thickness dimension, the connector comprising:

a first and a second spring clamp jaw, each spring clamp jaw having a forward end and a rearward end thereon, each of the flexible circuits being attached to a respective one of the clamp jaws adjacent to the forward end thereof, the clamp jaws being confrontationally arranged so that a portion of each clamp jaw adjacent to the rearward end thereof cooperate to define a channel through which the flexible circuits pass; and actuating means for opening the spring clamp jaws to space apart the forward ends thereof, wherein each flexible circuit has an end thereon and wherein the conductive tracings on each flexible circuit terminate a predetermined distance from the end thereof thereby to define on each flexible circuit a region that is free of conductive tracings, each flexible circuit being attached to the forward end of its respective spring clamp jaw within the region on the flexible circuit that is free of conductive tracings.

16. The connector of claim 15 wherein each of the spring clamp jaws has a concave region intermediate the forward and the rearward ends thereof, and wherein the actuating means lies within the concave region of the confrontationally arranged spring clamp jaws.

17. The connector of claim 15 wherein each of the spring clamp jaws has a concave region intermediate the forward and the rearward ends thereof, the concave region of each jaw having a lifting surface thereon, and wherein the actuating means comprises a first and a second actuator, each actuator being respectively disposed within the concave region of a respective one of the spring clamp jaws, each actuator comprising:

a bearing member having a bearing surface thereon, a rod rotationally received on the bearing surface, the rod having an actuating surface with an actuating edge defined thereon, and an actuating handle for rotating the rod with respect to the bearing surface to bring the actuating edge on the rod against the lifting surface on the concave portion of the spring clamp jaw within which it is disposed thereby to impose an opening force on the spring clamp jaw to open the same against its spring bias.

18. The connector of claim 17 wherein the rod is a generally cylindrical, and wherein the lifting surface on the concave region of each of the spring clamp jaws and the actuating surface on each of the rods are generally planar.

19. The connector of claim 17 wherein each rod has a camming surface thereon, the connector further comprising a fixture with first and a second abutment edge thereon, the fixture having a transition platform thereon, the transition platform having a first and a second surface, each surface of the transition platform having conductive landings thereon, the conductive landings on each respective surface of the transition platform being being electrically connected to the conductive paths on each respective surface of the substrate;

wherein rotation of the rod in each actuator to impose the opening force on its associated spring clamp jaw generates a restoring force in each of the spring clamp jaws and simultaneously presents the camming surface on each of the rods to one of the abutment edges on the fixture, the abutment edges and the camming surfaces being engageable such that relative movement therebetween in response to the restoring force in the spring clamp jaws generates a wiping motion acting in a predetermined wiping direction between the conductive landings on the first and second surfaces of the transition platform of the mixture and the conductive paths on respective first and second flexible circuits.

20. The connector of claim 1 wherein each spring clamp jaw has a positioning pin thereon, the positioning pin being disposed adjacent to the forward end of each spring clamp jaw, and wherein each of the first and second surface of the transition platform of the fixture has a positioning ridge thereon, the positioning pin on each spring clamp jaw and the positioning ridge on respective surface of the transition platform of the fixture being engageable to locate the each spring clamp jaw with respect to the surface of the transition platform so that the conductive tracings on each flexible circuit register with the conductive landings on each respective surface of the transition platform.

21. The connector of claim 20 wherein positioning ridge on each surface of the transition platform is generally wedge-shaped, with the closed end of the wedge aligning with the wiping direction and extending toward the connector.

22. The connector of claim 17 wherein each rod has a camming surface thereon, the connector further comprising a fixture with first and a second abutment edge thereon, wherein rotation of the rod in each actuator to impose the opening force on its associated spring clamp jaw generates a restoring force in each of the spring clamp jaws and simultaneously presents the camming surface on each of the rods to one of the abutment edges on the fixture, the abutment edges and the camming surfaces being engageable such that relative movement therebetween in response to the restoring force in the spring clamp jaws generates a wiping motion acting in a predetermined wiping direction between the conductive paths on the first and second surfaces of the substrate and the conductive tracings on the respective first and second flexible circuits.

23. The connector of claim 22 wherein each spring clamp jaw has a positioning pin thereon, the positioning pin being disposed adjacent to the forward end of each spring clamp jaw, and wherein the fixture has a first and a second positioning ridge thereon, the positioning pin on each spring clamp jaw and a respective one of the positioning ridges on the fixture being engageable to locate each spring clamp jaw with respect to the surface of the substrate so that the conductive tracings on each flexible circuit register with the conductive paths on each respective surface of the substrate.

24. The connector of claim 23 wherein each positioning ridge on the fixture is generally wedge-shaped, with the closed end of the wedge aligning with the wiping direction and extending toward the connector.

25. The connector of claim 15 wherein each spring clamp jaw has a positioning pin thereon, the positioning pin being disposed adjacent to the forward end of each spring clamp jaw, the connector further comprising a fixture, the fixture being attached to the substrate;

the fixture having a first and a second positioning ridge thereon, the positioning pin on each spring clamp jaw and one of the positioning ridges on the fixture being engageable to locate the each spring clamp jaw with respect to a surface of the substrate so that the conductive tracings on each flexible circuit register with the conductive paths on each respective surface of the substrate.

26. The connector of claim 25 wherein positioning surface on each surface of the transition platform is generally wedge-shaped, with the closed end of the wedge pointing toward a respective spring clamp jaw.

27. The connector of claim 15 wherein each spring clamp jaw has a positioning pin thereon, the positioning pin being disposed adjacent to the forward end of each spring clamp jaw, the connector further comprising a fixture, the fixture having a transition platform thereon, the transition platform having a first and a second surface, each surface of the transition platform having conductive landings thereon, the conductive landings on each respective surface of the transition platform being being electrically connected to the tracings on each respective surface of the substrate;

each of the first and second surfaces of the transition platform of the fixture having a positioning surface thereon, the positioning pin on each spring clamp jaw and the positioning surface on each respective surface of the transition platform of the fixture being engageable to locate the each spring clamp jaw with respect to the surface of the transition platform so that the conductive tracings on each flexible circuit register with the conductive landings on each respective surface of the transition platform.

28. The connector of claim 27 wherein positioning surface on each surface of the transition platform is generally wedge-shaped, with the closed end of the wedge pointing toward a respective spring clamp jaw.

* * * * *